US006354249B1

(12) United States Patent
Gerhardt

(10) Patent No.: US 6,354,249 B1
(45) Date of Patent: Mar. 12, 2002

(54) ENGINE WITH COOLANT PUMP

(75) Inventor: Todd R. Gerhardt, Grafton, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 09/593,638

(22) Filed: Jun. 13, 2000

(51) Int. Cl.[7] ..... F02B 47/00
(52) U.S. Cl. ..... 123/25 A
(58) Field of Search ..... 123/25 A, 41.44, 123/25 L

(56) References Cited

U.S. PATENT DOCUMENTS

| | | | | |
|---|---|---|---|---|
| 3,680,976 A | | 8/1972 | Buse | 415/110 |
| 4,434,748 A | * | 3/1984 | Smelser | 123/25 L |
| 4,621,981 A | * | 11/1986 | Lorett | 417/83 |
| 5,125,795 A | | 6/1992 | Suzuki et al. | 415/168.2 |
| 5,131,809 A | | 7/1992 | Gesenhues et al. | 415/168.2 |
| 5,154,576 A | | 10/1992 | Dorski et al. | 415/168.2 |
| 5,277,545 A | | 1/1994 | De Lange | 415/168.1 |
| 5,279,265 A | | 1/1994 | Matsuo et al. | 123/41.44 |
| 5,338,153 A | | 8/1994 | Swanson et al. | 415/168.2 |
| 5,355,847 A | | 10/1994 | Ozeki | 123/41.44 |
| 5,490,762 A | | 2/1996 | Feucht et al. | 415/168.1 |
| 5,660,521 A | | 8/1997 | Serio | 415/111 |
| 5,836,271 A | | 11/1998 | Sasaki et al. | 123/41.44 |

* cited by examiner

*Primary Examiner*—Willis R. Wolfe
*Assistant Examiner*—Katrina B. Harris
(74) *Attorney, Agent, or Firm*—Quarles & Brady LLP

(57) ABSTRACT

An internal combustion engine having a crankcase with at least one cylinder and a coolant passageway formed therein surrounding said cylinder. An engine air intake supplies combustion air to the cylinder, and a coolant pump pumps coolant through the coolant passageway for cooling the cylinder. A reservoir in fluid communication with the air intake collects coolant leaking from the coolant pump. Coolant in the reservoir is drawn into the air intake, and ingested by the cylinder.

9 Claims, 6 Drawing Sheets

ENGINE WITH COOLANT PUMP

FIELD OF THE INVENTION

The field of the invention relates to internal combustion engines, more particularly to a coolant pump for use in an internal combustion engine.

DESCRIPTION OF THE BACKGROUND ART

Liquid-cooled internal combustion generally includes a coolant pump having a rotatably drive impeller shaft which extends through an aperture into a working chamber filled with coolant A seal surrounding the shaft inhibits the coolant from leaking out of the working chamber through the aperture. Typically, however, a small amount of coolant manages to leak past the seal, and drip onto the ground.

Many coolant pumps have a reservoir to hold coolant that seeps past the seal. The reservoir typically has a vent hole that allows the coolant to evaporate into the atmosphere. However, if the seal fails, the coolant reservoir fills faster than the coolant can evaporate, and flows out of the vent hole onto the ground. The coolant will continue leaking until all of the coolant has leaked out of the engine without a warning to the user, or until the user notices the coolant on the ground. If the user does not notice the leaking coolant, the engine will fail.

SUMMARY OF THE INVENTION

The present invention provides an internal combustion engine having a crankcase with at least one cylinder and a coolant passageway formed therein surrounding the cylinder. An engine air intake supplies combustion air to the cylinder, and a coolant pump pumps coolant through the coolant passageway for cooling the cylinder. A reservoir in fluid communication with the air intake collects coolant leaking from the coolant pump. Coolant in the reservoir is drawn into the air intake, and ingested by the cylinder. An excessive amount of coolant ingested by the engine will degrade engine performance warning a user of a coolant leak.

A general objective of the present invention is to provide an internal combustion engine which prevents coolant from leaking onto the ground. This objective is accomplished by feeding coolant leaking from the coolant pump to the engine for ingestion by the engine with minimal impact.

Another objective of the present invention is to provide an internal combustion engine which can indicate a pump seal failure. This objective is accomplished by feeding coolant leaking past a failed seal in the coolant pump to the engine for ingestion by the engine to degrade engine performance, and warn the user of the seal failure.

The foregoing and other objects and advantages of the invention will appear from the following description. In the description, reference is made to the accompanying drawings which form a part hereof, and in which there is shown by way of illustration a preferred embodiment of the invention.

DETAILED DESCRIPTION OF THE PREFERRED EMBODIMENTS

Figure 1:
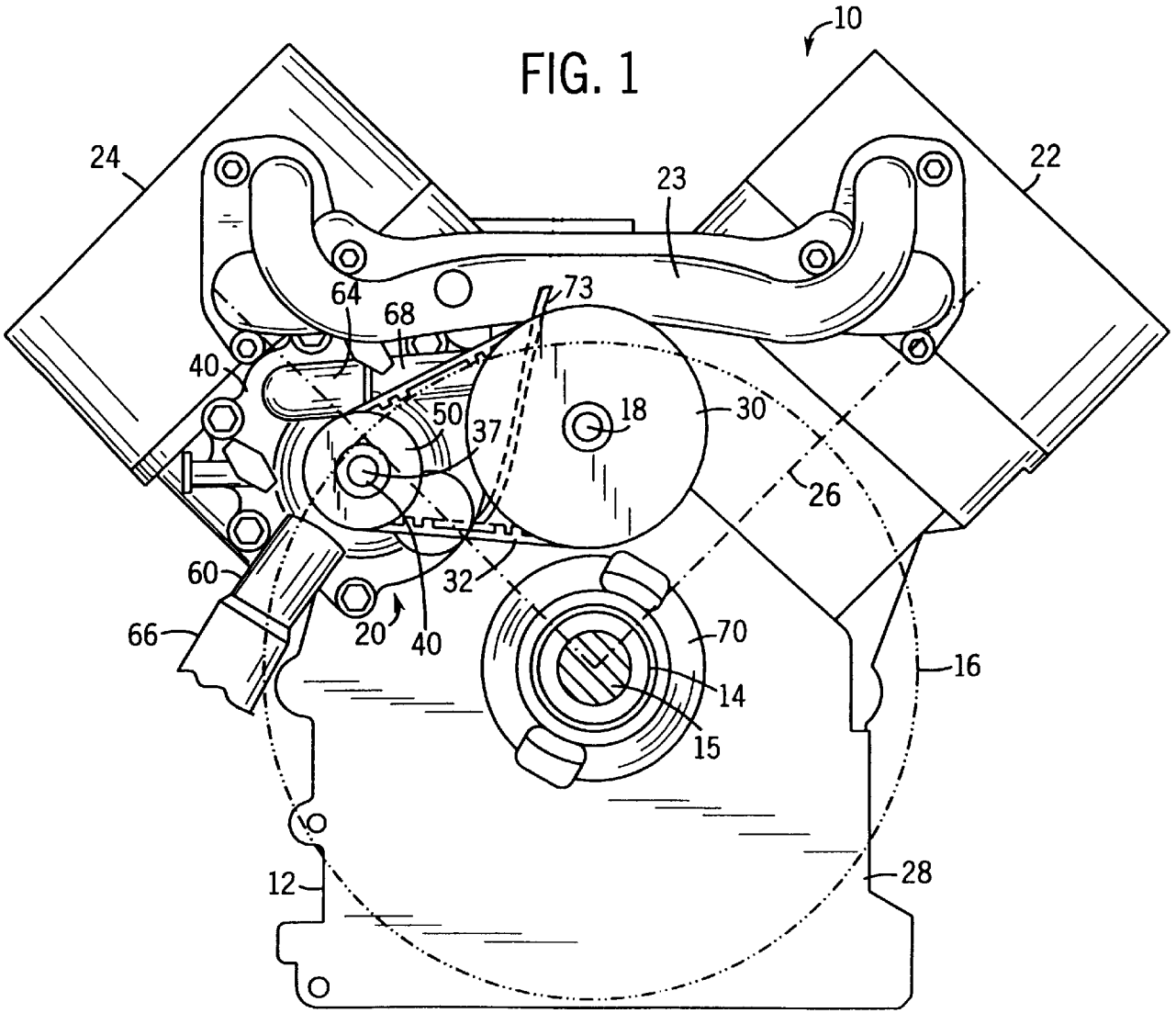
FIG. 1 is a top plan view of a vertical shaft V-type internal combustion engine incorporating the present invention.
Figure 2:
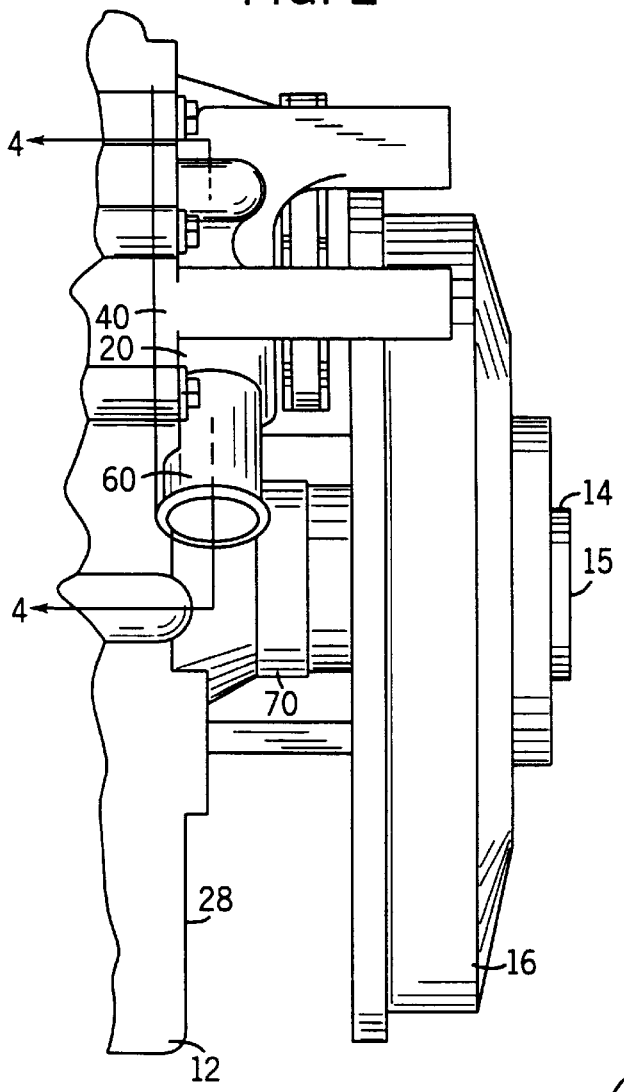
FIG. 2 is a partial elevational side view of the engine of FIG. 1.

Referring to FIGS. 1 and 2, a vertical shaft V-type internal combustion engine 10 includes a crankcase 12 with a top face 28, bottom face (not shown) and two cylinders 22, 24 formed therein defining a V 26 (shown by dashed lines). Pistons (not shown) received in the cylinders 22, 24 rotatably drive a crankshaft 14 having an end 15 extending through the crankcase top face 28 at the V 26 junction. A coolant pump 20 formed as an integral part of the crankcase top face 28 forces coolant through an engine cooling system during engine 10 operation. The cooling pump 20 has an impeller shaft 48 with a rotational axis 37 outside of the space defined by the V 26, and substantially covered by a flywheel 16 mounted on the crankshaft end 15.

The crankcase 12 is cast aluminum, and has two cylinders 22, 24 formed therein. The cylinders 22, 24 are arranged with one cylinder 22 vertically offset from the other cylinder 24, and to form a V 26. Each cylinder 22, 24 receives a reciprocating piston which rotatably drives the vertical crankshaft 14, and has a head (not shown) which encloses the piston therein. Coolant is circulated through water jackets 34 formed in the crankcase 12 and cylinder heads to cool the cylinders 22, 24 during engine 10 operation. Although a compact V-type two cylinder internal combustion engine is described herein, the engine may have any number of cylinders which are arranged in a V or other configuration, such as a straight line, without departing from the scope of the present invention.

The crankshaft 14 is rotatably mounted in the crankcase 12 at the V 26 junction. One end of the crankshaft 14 supports the flywheel 16 disposed above the crankcase top face 28, and the other crankshaft end (not shown) extends out of an oil pan (not shown) mounted to the crankcase bottom (not shown) to rotatably drive an apparatus, such as a lawn tractor or the like. A timing gear (not shown) engages the crankshaft 14, and rotatably drives the camshaft 18. The rotatably mounted camshaft 18 is disposed in the V space defined by the V 26 and controls valves which allow gases to enter or exit the cylinders 22, 24 during engine 10 operation. One end of the camshaft 18 extends past the crankcase top face 28, and has a sprocket 30 mounted thereon. The camshaft sprocket 30 engages a toothed drive belt 32 which rotatably drives the coolant pump 20.

Combustion air is supplied to the cylinders 22, 24 through an air intake 23 which includes a manifold to distribute the air to each cylinder. Operation of the engine creates a vacuum in the air intake 23 to draw air therein from the atmosphere through an air filter (not shown).

The internal combustion engine 10 is liquid cooled by forcing a coolant, such as water/ethylene glycol or the like, through a cooling system which includes the coolant pump 20 and water jackets 34. Operation of the internal combustion engine 10 generates heat in the cylinders 22, 24. The coolant flows through the water jackets 34 and absorbs the heat generated by the engine 10. The coolant is cooled as it passes through a radiator (not shown) and then returned to the water jackets 34 to absorb more heat from the engine 10.

Figure 3:
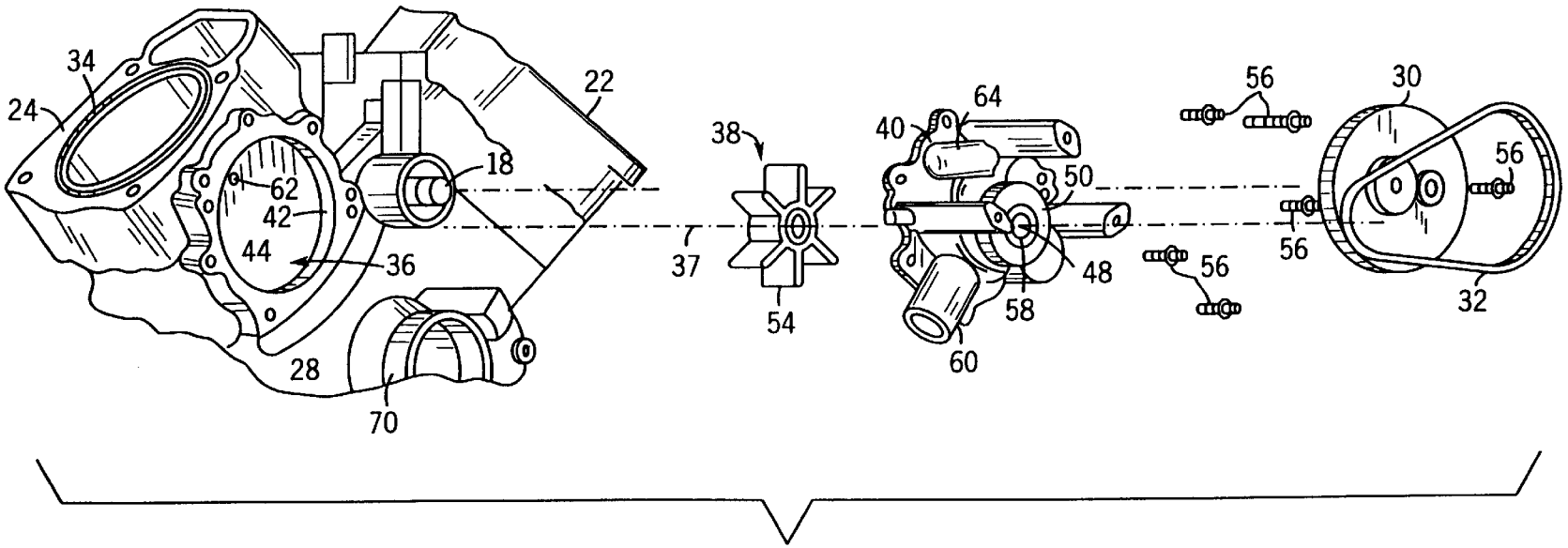
FIG. 3 is a partial exploded perspective view of the engine of FIG. 1.

Looking particularly at FIGS. 2 and 3, the coolant is forced through the cooling system by the coolant pump 20.

The coolant pump 20 is interposed between the crankcase top face 28 and flywheel 16, and includes a pump chamber 36 formed as an integral part of the crankcase top face 28, an impeller 38 rotatably mounted in the pump chamber 36, and a pump cover 40 enclosing the impeller 38 inside the pump chamber 36. Advantageously, positioning the pump 20 between the crankcase 12 and flywheel 16 increases the engine 10 height less than the height of the pump 20 because of the existing space between the crankcase 12 and flywheel 16. In addition, locating the pump 20 on the crankcase top face 28 provides easy access to the pump components to simplify pump maintenance or repair. Preferably, the pump 20 is disposed on a portion of the crankcase top face 28 defined by the cylinder 24 which is vertically offset furthest away from the flywheel 16 to take advantage of the cylinder offset and further minimize the engine 10 height.

Cooled coolant is channeled into the pump chamber 36, pressurized, and then forced through the cooling system. As shown in FIG. 3, the pump chamber 36 is a circular cavity having a perimeter wall 42 which is formed as an integral part of the crankcase top face 28, and defines a generally circular cavity bottom 44. Forming the chamber as an integral part of the crankcase top face reduces the number of engine parts. An outlet port 62 formed in the cavity bottom proximal the chamber perimeter wall feeds pressurized coolant to the offset cylinder 24 water jacket 34.

Figure 4:
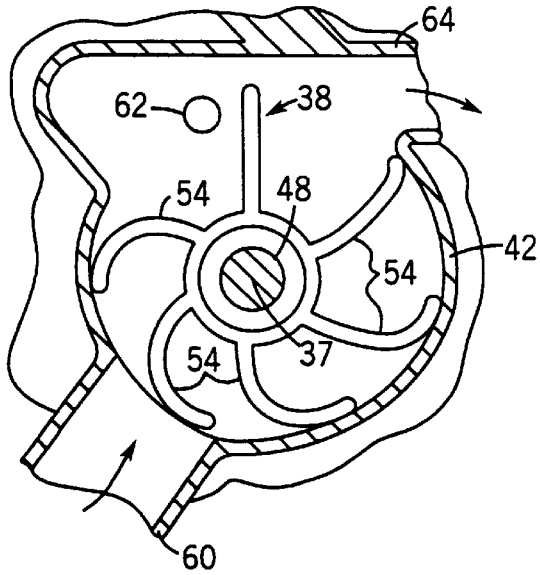
FIG. 4 is a sectional view along line 4—4 of FIG. 2.

The impeller 38 is rotatably driven about the pump axis 37 by the drive belt 32 and increases the coolant pressure in the pump chamber 36. The impeller 38 is mounted on an impeller shaft 48 which defines the central pump axis 37 disposed outside of the space defined by the V 26. One end of the impeller shaft 48 extends through the pump cover 40 and has a sprocket 50 mounted thereon. The impeller sprocket 50 engages the drive belt 32 engaged by the camshaft sprocket 30 to rotatably drive the impeller shaft 48. The opposing impeller shaft 48 end is disposed inside the pump chamber 36 and has the impeller 38 mounted thereon. As shown in FIG. 4, rotation of the impeller shaft 48 causes the impeller blades 54 to compress the coolant inside the chamber 36 and force it out of the chamber through the outlet port 62 and an outlet nipple 64.

The pump cover 40 is mounted over the pump chamber 36 to enclose the impeller blades 54 in the pump chamber 36. Preferably, the pump cover 40 is die cast aluminum and mounted to the crankcase 12 using methods known in the art, such as screws 56. Cooling system coolant is drawn into the chamber 36 through an inlet 60 formed in the cover 40. The outlet nipple 64 is formed as part of the pump cover 40 proximal the chamber perimeter wall 42, and feeds pressurized coolant to the non-offset cylinder 22 water jacket 34. By providing an outlet port 62 formed in the pump chamber bottom 44 and an outlet nipple 64 in the cover 40, coolant is fed to both cylinders 22, 24 in parallel. The engine cooling system could also be constructed to feed the cylinders 22, 24 in series without departing from the scope of the present invention by closing the outlet nipple 64 and communicatively connecting the water jacket 34 surrounding the offset cylinder 24 to the non-offset cylinder 22 water jacket 34, such as by way of an coolant intake manifold (not shown).

Figure 5:
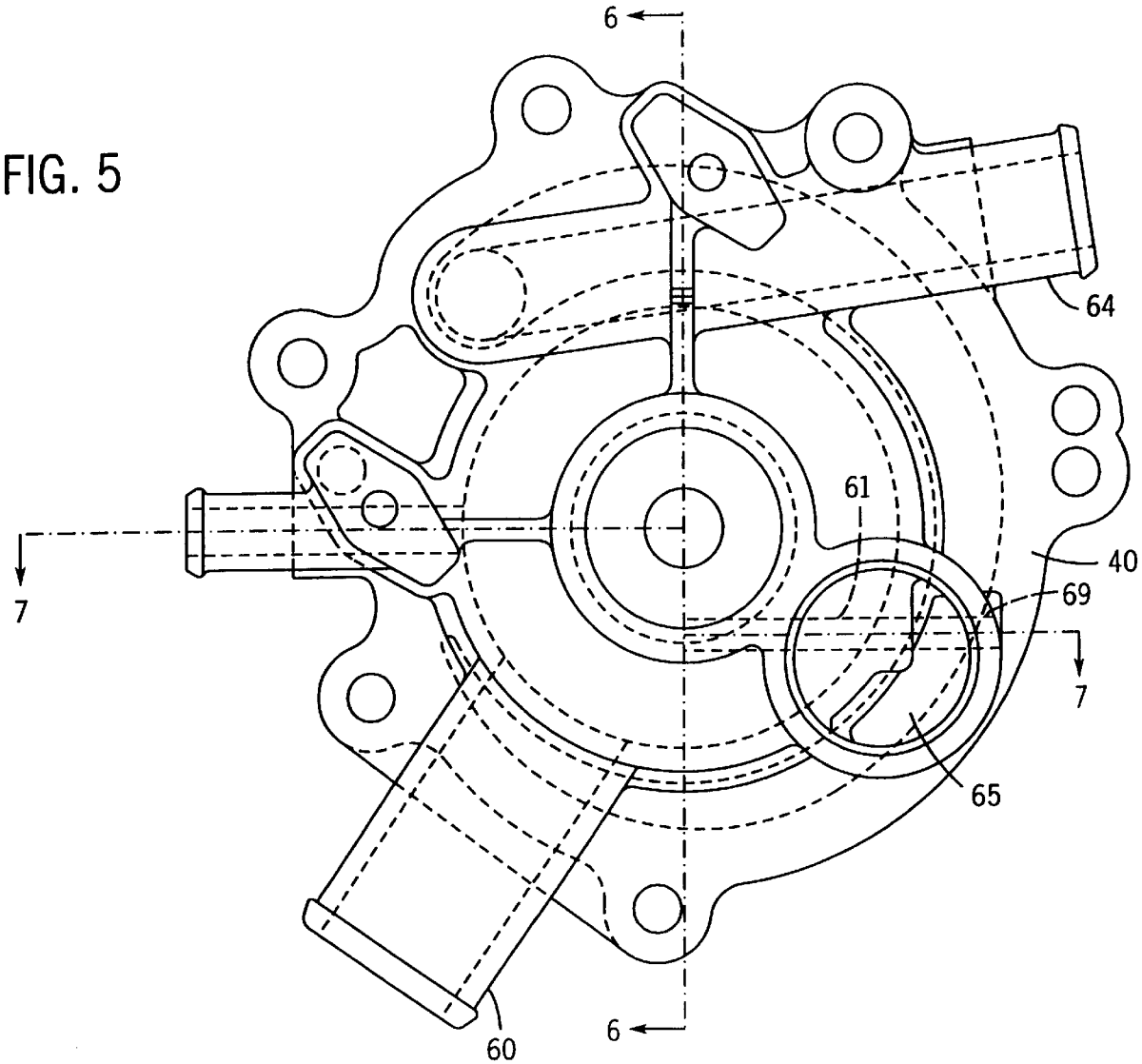
FIG. 5 is a plan view of the pump in FIG. 2.
Figure 6:
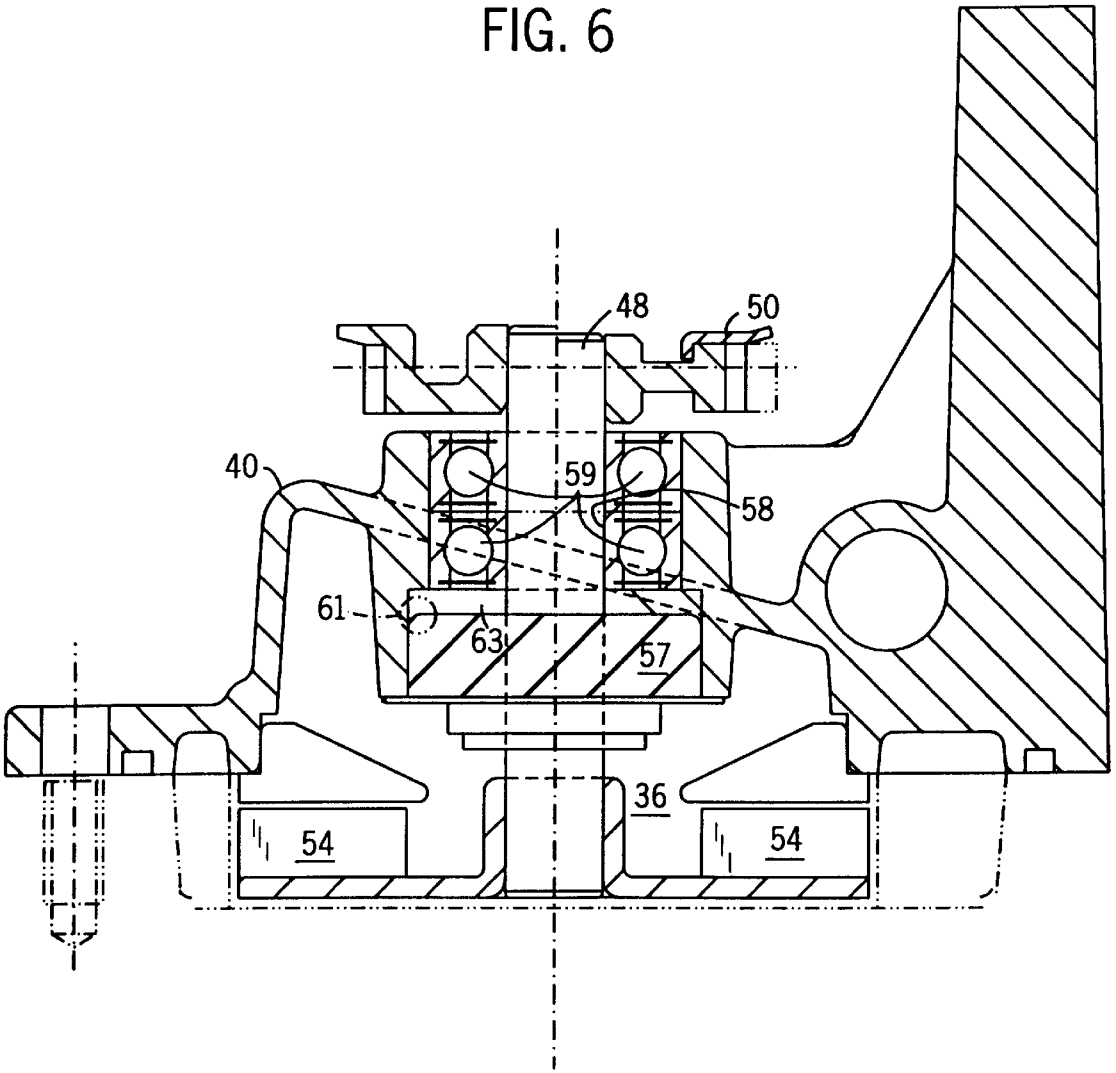
FIG. 6 is a sectional view along line 6—6 of the pump in FIG. 5.
Figure 7:
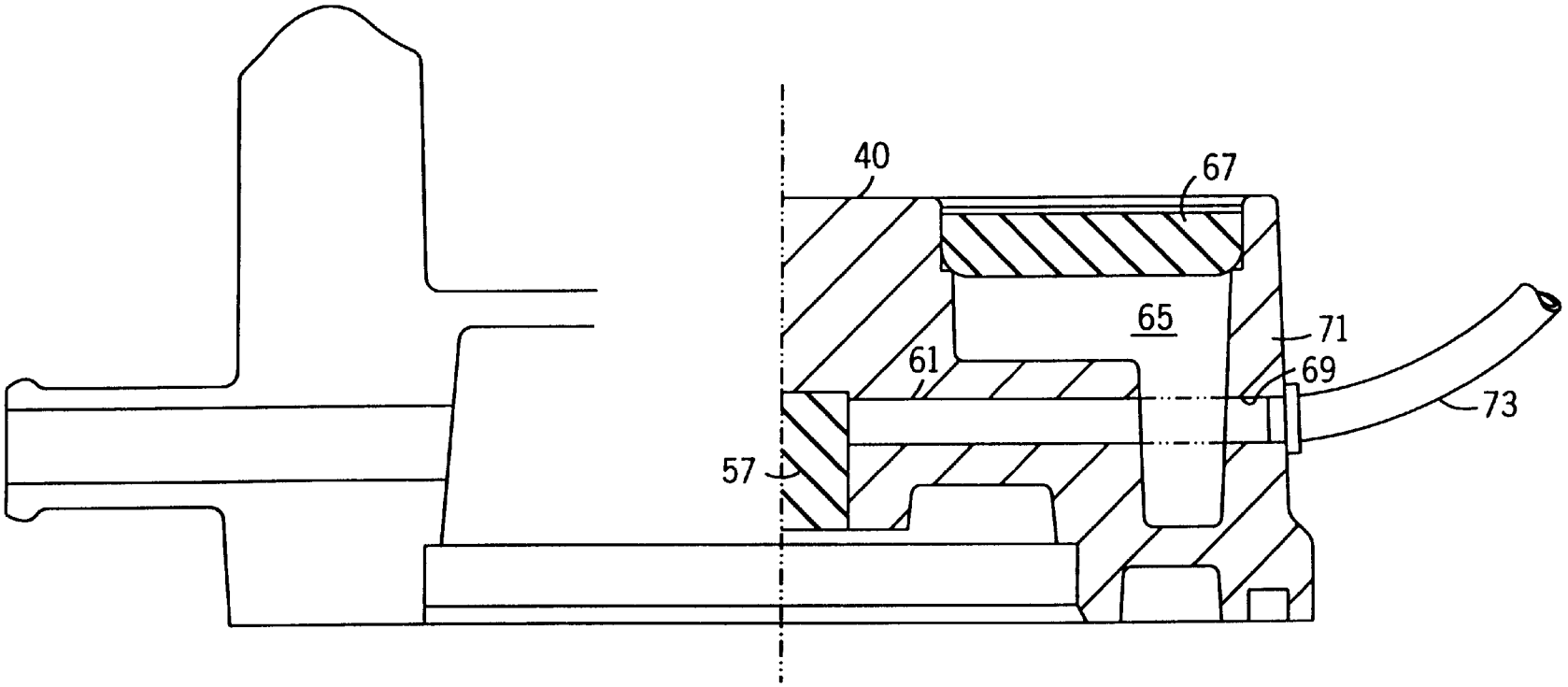
FIG. 7 is a sectional view along line 7—7 of the pump of FIG. 5.

Referring to FIGS. 5–7, a seal 57 interposed between the cover 40 and pump chamber 36, and surrounding the impeller shaft 48, seals the chamber 36 to inhibit leaks. The impeller shaft 48 extends through an opening 58 formed in the cover 40 which has bearings 59 mounted therein to reduce friction acting on the rotating impeller shaft 48, and support the drive belt 32 load. A passageway 61 formed in the cover 40 leading from a space 63 between the seal 57 and bearings 59 directs coolant leaking past the seal 57 to a reservoir 65.

The reservoir 65 collects the leaking coolant, and is defined by an outwardly facing cavity formed in the cover 40, and a plug 67 which seals the cavity opening. An aperture 69 formed in a reservoir wall 71 is in fluid communication with the air intake 23 by a hose 73. The vacuum in the air intake draws coolant out of the reservoir 65 and into the air intake 23. The small amount of coolant that normally collects in the reservoir 65 is then ingested into the engine 10 without impact. When the seal 57 fails allowing a large amount of coolant into the reservoir 65, the increased coolant in the air intake 23 cause the engine to run poorly. The poor engine operation signals the user of a pump seal failure.

Referring back to FIG. 1, hoses 66, 68, capable of transporting pressurized coolant at typical engine coolant temperatures, channel the coolant into and out of the cooling pump 20. An inlet hose 66 communicatively connected to the pump inlet 60 channels the coolant in the cooling system into the pump chamber 36. An outlet hose 68 communicatively connected to the outlet nipple 64 receives the pressurized coolant and channels it to the non-offset cylinder 22 waterjacket 34 for engine cooling. Preferably, the hoses 66, 68 are formed from materials known in the art for heated coolant under pressure, such as steel, rubber, or the like.

As shown in FIG. 1, the disc-shaped flywheel 16 is mounted to the crankshaft 14 end extending through the crankcase top face 28 and minimizes rotational speed fluctuations due to changes in a load on the engine 10. The flywheel 16 is disposed above and substantially covers the crankcase top face 28 and coolant pump 20. Referring to FIG. 2, preferably, a spacer 70 surrounding the crank shaft 14 and formed as an integral part of the crankcase top face 28 is interposed between the flywheel 16 and crankcase 12 to offset the flywheel 16 away from the crankcase top face 28 and prevent flywheel 16 interference with the coolant pump 20. Although the spacer 70 is preferably formed as an integral part of the crankcase top face 28 or flywheel 16, the spacer 70 may be a separate part mounted to the crankcase top face 28 or flywheel 16 without departing from the scope of the present invention. Most preferably, the spacer is a main bearing tower formed part of the engine crankcase housing a crankshaft main bearing.

While there has been shown and described what are at present considered the preferred embodiment of the invention, it will be obvious to those skilled in the art that various changes and modifications can be made therein without departing from the scope of the invention.

I claim:

1. An internal combustion engine comprising:

a crankcase with at least one cylinder and a coolant passageway formed therein surrounding said cylinder;

an engine air intake supplying combustion air to said cylinder;

a coolant pump for pumping coolant through said coolant passageway for cooling said cylinder; and a reservoir for collecting coolant leaking from said coolant pump, said reservoir being in fluid communication with said air intake, wherein coolant in said reservoir is drawn into said air intake and ingested by the engine.

2. The internal combustion engine as in claim 1 in which said crankcase includes a plurality of cylinders arranged so as to form a V.

3. The internal combustion engine as in claim 1, wherein said crankcase has four or fewer cylinders formed therein.

4. The internal combustion engine as in claim 1, in which said coolant pump includes a bearing supporting a shaft and a seal member sealing a working chamber of said coolant pump, and said reservoir is in fluid communication with a space interposed between said bearing and said seal member.

5. A coolant pump for use in an internal combustion engine comprising:

a housing defining a working chamber;

a shaft freely rotatably mounted in said housing via a bearing;

an impeller fixed to one end of said shaft and accommodated in said working chamber;

a seal member provided between said impeller and said bearing within said housing and around said shaft, a space in said housing between said bearing and said seal member for receiving coolant leaking past said seal member from said working chamber; and suction means for drawing coolant out of said space, in which said suction means is an air intake for an internal combustion engine, said air intake being in fluid communication with said space.

6. A method of detecting coolant leaking from a coolant pump pumping coolant to cool an internal combustion engine, said method comprising the steps of:

collecting coolant leaking from a coolant pump into a reservoir;

drawing coolant out of said reservoir; and feeding said coolant into cylinder combustion chambers of the internal combustion engine to degrade engine operation.

7. The method of claim 6, in which the step of drawing coolant out of said reservoir includes drawing the coolant out of said reservoir, and into an engine air intake.

8. An internal combustion engine comprising:

a crankcase with at least one cylinder;

an engine air intake supplying combustion air to said cylinder;

a fluid pump driven by the engine for pumping fluid; and a reservoir for collecting fluid leaking from said fluid pump, said reservoir being in fluid communication with said air intake, wherein fluid in said reservoir is drawn into said air intake and ingested by the engine.

9. The internal combustion engine as in claim 8, in which said fluid is coolant pumped by said fluid pump through coolant passageways formed in said crankcase surrounding said cylinder for cooling said cylinder.

* * * * *